US005277119A

United States Patent [19]

Ricco, Sr.

[11] Patent Number: 5,277,119

[45] Date of Patent: * Jan. 11, 1994

[54] 9MM CARTRIDGE CASING

[76] Inventor: John A. Ricco, Sr., P.O. Box 232, Pineville, Pa. 18946

[ * ] Notice: The portion of the term of this patent subsequent to Feb. 16, 2010 has been disclaimed.

[21] Appl. No.: 940,046

[22] Filed: Sep. 3, 1992

Related U.S. Application Data

[63] Continuation-in-part of Ser. No. 858,672, Mar. 27, 1992, Pat. No. 5,187,324.

[51] Int. Cl.[5] ..... F42B 5/28

[52] U.S. Cl. ..... 102/464; 102/469

[58] Field of Search ..... 102/430, 464, 468, 469, 102/470

[56] References Cited

U.S. PATENT DOCUMENTS

| | | | |
|---|---|---|---|
| 4,483,251 | 11/1984 | Spalding | 102/464 |
| 5,094,169 | 3/1992 | Evitts | 102/464 |
| 5,187,324 | 2/1993 | Ricco, Sr. | 102/464 |

OTHER PUBLICATIONS

Cartridges of the World by Barnes, Follett Publishing Co. 1965, pp. 177 and 178.

Lyman Reloading Handbook for Rifle, Pistol and Muzzle Loading 1970, pp. 164 and 165.

*Primary Examiner*—Harold J. Tudor

*Attorney, Agent, or Firm*—Robert Charles Beam

[57] ABSTRACT

The present invention shows an improved 9 mm cartridge casing having greater strength and reliability. This cartridge casing is a substantially hollow cylinder of a suitable metallic material with a length of about nine hundred thousandths of an inch (0.900 in.). The casing is unique in that its external dimensions include a first end portion having an outer diameter of from about three hundred ninety-two thousandths of an inch (0.392 in.) to about four hundred one thousandths of an inch (0.401).

The casing also has an opposite end portion with an outer wall which uniformly decreases in diameter from a diameter of from about three hundred ninety-two thousandths (0.392 in.) to about four hundred and one thousandths of an inch (0.401 in.). to an diameter of about three hundred eighty thousandths of an inch (0.380 in.).

2 Claims, 1 Drawing Sheet

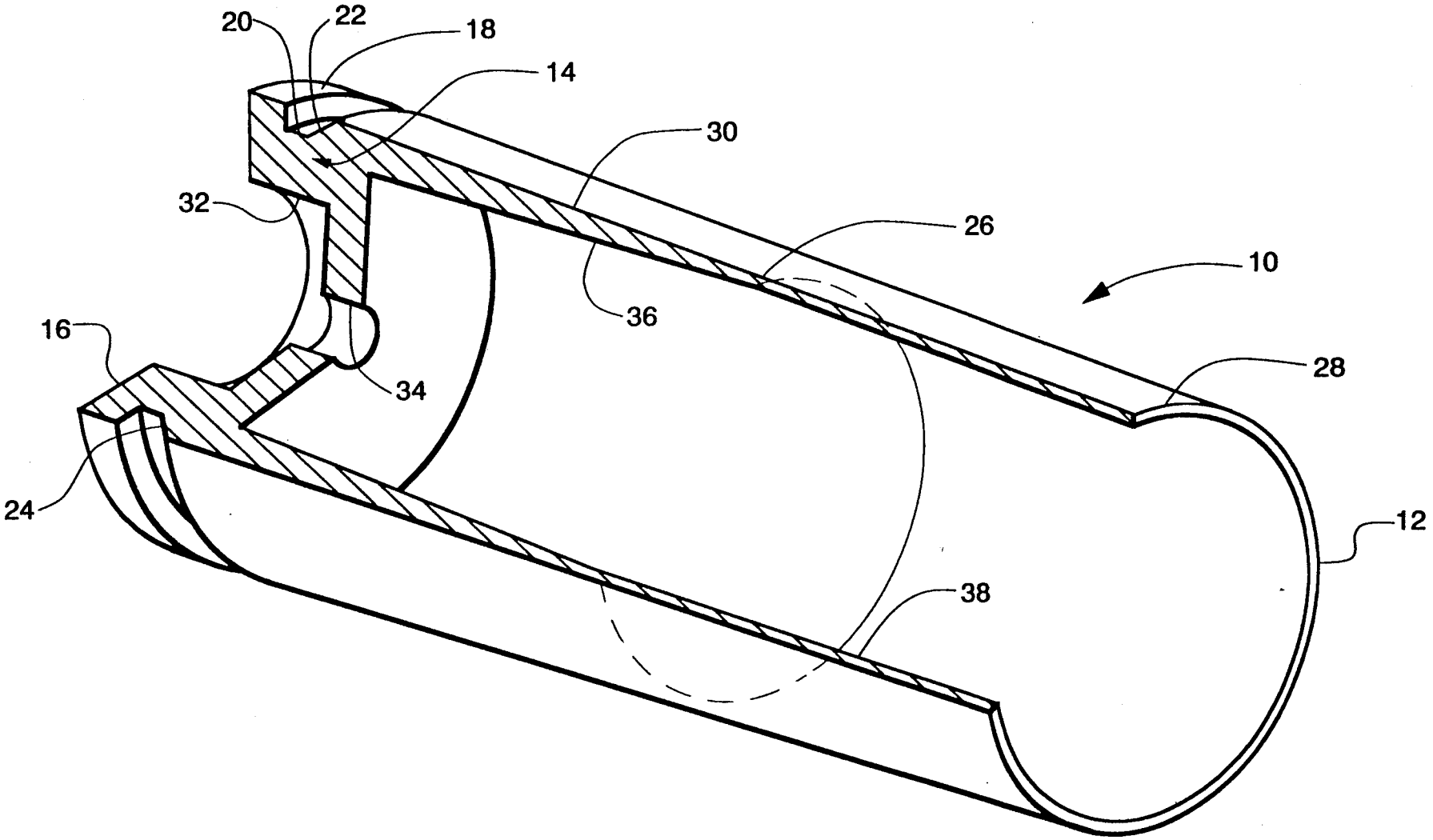
10
12
14
16
18
20
22
24
26
28
30
32
34
36
38

9MM CARTRIDGE CASING

BACKGROUND OF THE INVENTION

This application in a continuation-in-part of U.S. patent application Ser. No. 07/858,672, filed Mar. 27, 1992.

1. Field of the Invention

The present invention relates to an improved 9 mm cartridge casing. In particular, the present invention relates to An improved 9 mm cartridge casing having greater strength and reliability, which cartridge casing comprises:

a substantially hollow cylindrical casing of suitable metallic material having a length of from about eight hundred ninety thousandths of an inch (0.890 in.) to about nine hundred thousandths of an inch (0.900 in.), said casing having as its external dimensions:

a first end portion extending from about forty thousandths of an inch (0.040 in.) to about fifty thousandths of an inch (0.050 in.) from the first end thereof, and having an outer diameter of from about three hundred ninety-two thousandths of an inch (0.392 in.) to about four hundred and one thousandths of an inch (0.401 in.);

a first intermediate portion extending from about twenty-one thousandths of an inch (0.021 in.) to about forty-nine thousandths of an inch (0.049 in.) from said first end portion thereof, and having an outer diameter of from about three hundred thirty-three thousandths of an inch (0.333 in.) to about three hundred forty-eight thousandths of an inch (0.348 in.);

a second intermediate portion extending from about twenty-one thousandths of an inch (0.021 in.) to about forty-nine thousandths of an inch (0.049 in.) from said first intermediate portion thereof, and having an outer wall which increases in diameter from about a diameter of from about three hundred thirty-three thousandths of an inch (0.333 in.) to about three hundred forty-eight thousandths of an inch (0.348 in.) to about a diameter of from about three hundred ninety-two thousandths of an inch (0.392 in.) to about four hundred and one thousandths of an inch (0.401 in.) at a substantially constant rate of increase of from about thirty degrees (30°) to forty degrees (40°) from the centerline of said casing; and, a second and opposite end portion extending for the remaining length of said casing, and having an outer wall which uniformly decreases in diameter from about a diameter of from about three hundred ninety-two thousandths of an inch (0.392 in.) to about four hundred and one thousandths of an inch (0.401 in.) to a diameter of from about three hundred seventy-two thousandths of an inch (0.372 in.) to about three hundred eighty thousandths of an inch (0.380 in.);

and as its interior dimensions:

a first interior portion extending from about one hundred fifteen thousandths of an inch (0.115 in.) to about one hundred twenty-one thousandths of an inch (0.121 in.) from the first end thereof, and having an inner diameter of from about one thousand seven hundred thirty-two ten-thousandths of an inch (0.1732 in.) to about one thousand seven hundred forty-four ten-thousandths of an inch (0.1744 in.);

a second interior portion extending for a minimum of at least about forty thousandths of an inch (0.040 in.), and having an inner diameter of about from seventy-nine thousandths of an inch (0.079 in.) to about eighty-three thousandths of an inch (0.083 in.);

a third interior portion extending to about from about five hundred seventy thousandths of an inch (0.570 in.) to about five hundred ninety thousandths of an inch (0.590 in.) from said first end of the casing, and having an inner diameter which increases to from about three hundred fifty-two thousandths of an inch (0.352 in.) to about three hundred fifty-six thousandths of an inch (0.356 in.); and, a fourth interior portion extending from said third interior portion to the second and opposite end of said casing, and having a constant inner diameter of from about three hundred fifty-two thousandths of an inch (0.352 in.) to about three hundred fifty-six thousandths of an inch (0.356 in.).

2. Description of Related Art

The nine-millimeter (9 mm) cartridge, introduced by Georg Luger in 1902 and called the 9 mm Parabellum, is believed to be the most widely used military pistol cartridge in the world. It is used by a number of law enforcement agencies in the United States and has been adopted by the U.S. armed services, using a 9 mm Beretta pistol, as the official sidearm.

The 9 mm cartridge is only slightly smaller in dimension than the 0.38 caliber cartridge developed by Colt and Browning in 1900. However, the 9 mm cartridge was better adapted to use in automatic weapons, where the larger rim of the 0.38 cartridge and the straight wall design would interfere with automatic mechanisms. Further, the straight wall, though it accommodated more interior space in the cartridge, could not safely be loaded with an equivalent charge or reloaded easily, because the thinner casing wall would fail.

In an effort to increase the speed and power of a fired cartridge, many users changed to larger diameter bullets, with larger cartridge casings. However, the larger cartridge casings were bulky and prevented the use of larger magazines, allowing rapid fire of multiple cartridges. In addition, the larger caliber bullets had significantly higher recoil and the ballistics of the larger bullet are more difficult to control.

The 9 mm cartridge, because of its wide acceptance and use, lower recoil, and because its tapered exterior and heavier-walled construction, became widely used, particularly in automatic and semi-automatic weapons.

The cartridge casing of a standard 9 mm cartridge casing, however, like the 9 mm NATO (North American Treaty Organization) round, was only nineteen millimeters (19 mm) in length. To increase the power of the round, manufacturers began lengthening the casing, first to twenty-one millimeters (21 mm), and more recently to twenty-three millimeters (23 mm). While such expanded sizes have permitted increased charge loading, the limits of the cartridge casing design prevent any further pressure increases in the loading, and it is common for cartridges to fail at such substantial pressures.

SUMMARY OF THE INVENTION

It is an object of the present invention to provide a stronger and safer nine millimeter (9 mm) cartridge casing which will permit greater cartridge pressures, allowing increased charge loading.

It is a further object of the present invention to provide a more powerful nine millimeter (9 mm) cartridge which can be employed in existing firearms with minimal change.

The other objects, features and advantages of the present invention will become more apparent in light of the following detailed description of the preferred embodiment thereof.

According to the preferred embodiment of the present invention, there is provided An improved 9 mm cartridge casing having greater strength and reliability, which cartridge casing comprises:

a substantially hollow cylindrical casing of suitable metallic material having a length of from about eight hundred ninety thousandths of an inch (0.890 in.) to about nine hundred thousandths of an inch (0.900 in.), said casing having as its external dimensions:

a first end portion extending from about forty thousandths of an inch (0.040 in.) to about fifty thousandths of an inch (0.050 in.) from the first end thereof, and having an outer diameter of from about three hundred ninety-two thousandths of an inch (0.392 in.) to about four hundred and one thousandths of an inch (0.401 in.);

a first intermediate portion extending from about twenty-one thousandths of an inch (0.021 in.) to about forty-nine thousandths of an inch (0.049 in.) from said first end portion thereof, and having an outer diameter of from about three hundred thirty-three thousandths of an inch (0.333 in.) to about three hundred forty-eight thousandths of an inch (0.348 in.);

a second intermediate portion extending from about twenty-one thousandths of an inch (0.021 in.) to about forty-nine thousandths of an inch (0.049 in.) from said first intermediate portion thereof, and having an outer wall which increases in diameter from about a diameter of from about three hundred thirty-three thousandths of an inch (0.333 in.) to about three hundred forty-eight thousandths of an inch (0.348 in.) to about a diameter of from about three hundred ninety-two thousandths of an inch (0.392 in.) to about four hundred and one thousandths of an inch (0.401 in.) at a substantially constant rate of increase of from about thirty degrees (30°) to forty degrees (40°) from the centerline of said casing; and, a second and opposite end portion extending for the remaining length of said casing, and having an outer wall which uniformly decreases in diameter from about a diameter of from about three hundred ninety-two thousandths of an inch (0.392 in.) to about four hundred and one thousandths of an inch (0.401 in.) to a diameter of from about three hundred seventy-two thousandths of an inch (0.372 in.) to about three hundred eighty thousandths of an inch (0.380 in.);

and as its interior dimensions:

a first interior portion extending from about one hundred fifteen thousandths of an inch (0.115 in.) to about one hundred twenty-one thousandths of an inch (0.121 in.) from the first end thereof, and having an inner diameter of from about one thousand seven hundred thirty-two ten-thousandths of an inch (0.1732 in.) to about one thousand seven hundred forty-four ten-thousandths of an inch (0.1744 in.);

a second interior portion extending for a minimum of at least about forty thousandths of an inch (0.040 in.), and having an inner diameter of about from seventy-nine thousandths of an inch (0.079 in.) to about eighty-three thousandths of an inch (0.083 in.);

a third interior portion extending to about from about five hundred seventy thousandths of an inch (0.570 in.) to about five hundred ninety thousandths of an inch (0.590 in.) from said first end of the casing, and having an inner diameter which increases to from about three hundred fifty-two thousandths of an inch (0.352 in.) to about three hundred fifty-six thousandths of an inch (0.356 in.); and, a fourth interior portion extending from said third interior portion to the second and opposite end of said casing, and having a constant inner diameter of from about three hundred fifty-two thousandths of an inch (0.352 in.) to about three hundred fifty-six thousandths of an inch (0.356 in.).

BRIEF DESCRIPTION OF THE DRAWING

The Drawing shows, partly broken away and in cross-section, the cartridge casing of the preferred embodiment.

DETAILED DESCRIPTION OF THE PREFERRED EMBODIMENT

The preferred embodiment 10, shown in the Drawing, is an improved 9 mm cartridge casing having greater strength and reliability. This cartridge casing 10 comprises a substantially hollow cylindrical casing 12 of suitable metallic material 14 having a length of from about eight hundred ninety thousandths of an inch (0.890 in.) to about nine hundred thousandths of an inch (0.900 in.). A cartridge casing of such a length can be loaded with a 9 mm bullet and will still be within the critical dimensions necessary to be housed in the magazines of automatic 9 mm weapons.

The preferred embodiment 10 of the present invention comprises a cylindrical casing 12 having certain external dimensions. At the first end 16 the casing is provided with a first end portion 18, which extends from about forty thousandths of an inch (0.040 in.) to about fifty thousandths of an inch (0.050 in.) from that first end 16 of the cylindrical casing 12. This first end portion 18 has an outer diameter of from about three hundred ninety-two thousandths of an inch (0.392 in.) to about four hundred and one thousandths of an inch (0.401 in.). This is larger than the corresponding portion of a typical 9 mm cartridge, the dimension of the NATO round cited above is a maximum of three hundred and ninety-two thousandths of an inch (0.392 in.), but a maximum length of only nineteen millimeters (19 mm.). However, the dimension of cartridge casing of the present invention is still provided with sufficient bolt face in standard 9 mm weapons.

More suitably, the outer diameter of the first end portion 18 of the preferred embodiment of the present invention should be from about three hundred ninety-two thousandths of an inch (0.392 in.) to about three hundred ninety-eight thousandths of an inch (0.398 in.). Most suitably, the outer dimension of the first end portion 18 of the preferred embodiment of the present invention should be about three hundred ninety-eight thousandths of an inch (0.398 in.).

The preferred embodiment 10 of the present invention further comprises a first intermediate portion 20, extending from about twenty-one thousandths of an inch (0.021 in.) to about forty-nine thousandths of an inch (0.049 in.) from said first end portion 18. This first intermediate portion 20, has an outer diameter of from about three hundred thirty-three thousandths of an inch (0.333 in.) to about three hundred forty-eight thousandths of an inch (0.348 in.). This portion of the cartridge casing is utilized by the extraction mechanism of a pistol, and conforms to the standard dimensions for a 9 mm cartridge.

The preferred embodiment 10 of the present invention further comprises a second intermediate portion 22, extending from about twenty-one thousandths of an inch (0.021 in.) to about forty-nine thousandths of an inch (0.049 in.) from said first intermediate portion 20. This second intermediate portion 22 has an outer wall 24 which increases in diameter from about a diameter of from about three hundred thirty-three thousandths of an inch (0.333 in.) to about three hundred forty-eight thousandths of an inch (0.348 in.) to about a diameter of from about three hundred ninety-two thousandths of an inch (0.392 in.) to about four hundred and one thousandths of an inch (0.401 in.) at a substantially constant rate of increase of from about thirty degrees (30°) to forty degrees (40°) from the centerline of said casing along its length.

More suitably, the final outer diameter of the second intermediate portion 22 of the preferred embodiment of the present invention should be from about three hundred ninety-two thousandths of an inch (0.392 in.) to about three hundred ninety-eight thousandths of an inch (0.398 in.). Most suitably, the final outer dimension of the second intermediate portion 22 of the preferred embodiment of the present invention should be about three hundred ninety-eight thousandths of an inch (0.398 in.).

Finally, the external dimension of the preferred embodiment of the present invention comprises a second and opposite end portion 26 extending for the remaining length of said casing 12 to the second and opposite end 28 thereof. This second end portion 26 has an outer wall 30 which uniformly decreases in diameter, tapers, from about a diameter of from about three hundred ninety-two thousandths of an inch (0.392 in.) to about four hundred and one thousandths of an inch (0.401 in.) to a diameter of from about three hundred seventy-two thousandths of an inch (0.372 in.) to about three hundred eighty thousandths of an inch (0.380 in.).

More suitably, in the preferred embodiment of the present invention the outer wall 30 uniformly decreases from a diameter of from about three hundred ninety-two thousandths of an inch (0.392 in.) to about three hundred ninety-eight thousandths of an inch (0.398 in.). Most suitably, in the preferred embodiment of the present invention the outer wall 30 uniformly decreases from a diameter of about three hundred ninety-eight thousandths of an inch (0.398 in.).

With continued reference to the Drawing, the preferred embodiment 10 of the present invention has certain interior dimensions. These dimensions include a first interior portion 32 extending from about one hundred fifteen thousandths of an inch (0.115 in.) to about one hundred twenty-one thousandths of an inch (0.121 in.) from the first end 16 of the cylindrical casing 12. This first interior portion 32 has an inner diameter of from about one thousand seven hundred thirty-two ten-thousandths of an inch (0.1732 in.) to about one thousand seven hundred forty-four ten-thousandths of an inch (0.1744 in.).

Further, the preferred embodiment 10 of the present invention has a second interior portion 34 extending for a minimum of at least about forty thousandths of an inch (0.040 in.) from said first interior portion 32. This second interior portion 34 has an inner diameter of from about seventy-nine thousandths of an inch (0.079 in.) to about eighty-three thousandths of an inch (0.083 in.).

The preferred embodiment 10 of the present invention further comprises a third interior portion 36 extending to about from about five hundred seventy thousandths of an inch (0.570 in.) to about five hundred ninety thousandths of an inch (0.590 in.) from said first end 16 of the cylindrical casing 12. This third interior portion 36 has an inner diameter which increases to from about three hundred fifty-two thousandths of an inch (0.352 in.) to about three hundred fifty-six thousandths of an inch (0.356 in.) along its length.

Finally, the preferred embodiment 10 of the present invention further comprises a fourth interior portion 38 extending from said third interior portion 36 to the second and opposite end 28 of said cylindrical casing 12. This fourth interior portion 38 has a constant inner diameter of from about three hundred fifty-two thousandths of an inch (0.352 in.) to about three hundred fifty-six thousandths of an inch (0.356 in.).

The cartridge casing of the present invention requires modification of the barrel of existing 9 mm firearms to accommodate the larger external dimensions. However, use of the 21 mm and 23 mm cartridge lengths, which is becoming common, also requires barrel modification, as well. In recompense, the present invention offers further advantages which a simple extension of the existing cartridge lengths does not.

The manufacture of the cartridge casing of the present invention is difficult with the metallic blanks employed in traditional cartridge design. It is believed that cartridges within the smaller diameters of the present invention, from about three hundred ninety-two thousandths of an inch (0.392 in.) to about three hundred ninety-four thousandths of an inch (0.394 in.) can be manufactured from standard metal blanks. However, slightly larger metallic blanks are believed to be necessary to provide a sufficient quantity of metal for the fabrication of cartridges with a diameter of three hundred ninety-five thousandths of an inch (0.395 in.) and above. This requirement for additional workable metal illustrates most clearly that the wall thickness of the cartridge of the present design, especially in the critical area at the base of the powder charge, has greater dimension than in traditional cartridge designs.

This greater wall thickness permits stronger charge loading, and the cartridge of the present design can be rated "+P+" indicating such greater charge loads. At the same time, such increased thicknesses mean that the cartridge can be provided with standard loading with increased safety and reliability.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. An improved 9 mm cartridge casing having greater strength and reliability, which cartridge casing comprises:

a substantially hollow cylindrical casing of suitable metallic material having a length of from about eight hundred ninety thousandths of an inch (0.890 in.) to about nine hundred thousandths of an inch (0.900 in.), said casing having as its external dimensions:

a first end portion extending from about forty thousandths of an inch (0.040 in.) to about fifty thousandths of an inch (0.050 in.) from the first end thereof, and having an outer diameter of about three hundred ninety-two thousandths of an inch (0.392 in.);

a first intermediate portion extending from about twenty-one thousandths of an inch (0.021 in.) to about forty-nine thousandths of an inch (0.049 in.) from said first end portion thereof, and having an outer diameter of from about three hundred thirty-three thousandths of an inch (0.333 in.) to about three hundred forty-eight thousandths of an inch (0.348 in.);

a second intermediate portion extending from about twenty-one thousandths of an inch (0.021 in.) to about forty-nine thousandths of an inch (0.049 in.) from said first intermediate portion thereof, and having an outer wall which increases in diameter from about a diameter of from about three hundred thirty-three thousandths of an inch (0.333 in.) to about three hundred forty-eight thousandths of an inch (0.348 in.) to a diameter of about three hundred ninety-two thousandths of an inch (0.392 in.) at a substantially constant rate of increase of from about thirty degrees (30°) to forty degrees (40°) from the centerline of said casing; and, a second and opposite end portion extending for the remaining length of said casing, and having an outer wall which uniformly decreases in diameter from a diameter of from about three hundred ninety-two thousandths of an inch (0.392 in.) to a diameter of from about three hundred seventy-two thousandths of an inch (0.372 in.) to about three hundred eighty thousandths of an inch (0.380 in.);

and as its interior dimensions:

a first interior portion extending from about one hundred fifteen thousandths of an inch (0.115 in.) to about one hundred twenty-one thousandths of an inch (0.121 in.) from the first end thereof, and having an inner diameter of from about one thousand seven hundred thirty-two ten-thousandths of an inch (0.1732 in.) to about one thousand seven hundred forty-four ten-thousandths of an inch (0.1744 in.);

a second interior portion extending for a minimum of at least about forty thousandths of an inch (0.040 in.), and having an inner diameter of about from seventy-nine thousandths of an inch (0.079 in.) to about eighty-three thousandths of an inch (0.083 in.);

a third interior portion extending to about from about five hundred seventy thousandths of an inch (0.570 in.) to about five hundred ninety thousandths of an inch (0.590 in.) from said first end of the casing, and having an inner diameter which increases to from about three hundred fifty-two thousandths of an inch (0.352 in.) to about three hundred fifty-six thousandths of an inch (0.356 in.); and, a fourth interior portion extending from said third interior portion to the second and opposite end of said casing, and having a constant inner diameter of from about three hundred fifty-two thousandths of an inch (0.352 in.) to about three hundred fifty-six thousandths of an inch (0.356 in.).

2. An improved 9 mm cartridge casing having greater strength and reliability, which cartridge casing comprises:

a substantially hollow cylindrical casing of suitable metallic material having a length of from about eight hundred ninety thousandths of an inch (0.890 in.) to about nine hundred thousandths of an inch (0.900 in.), said casing having as its external dimensions:

a first end portion extending from about forty thousandths of an inch (0.040 in.) to about fifty thousandths of an inch (0.050 in.) from the first end thereof, and having an outer diameter of about three hundred ninety-two thousandths of an inch (0.392 in.) to about three hundred ninety-five thousandths of an inch (0.395 in.);

a first intermediate portion extending from about twenty-one thousandths of an inch (0.021 in.) to about forty-nine thousandths of an inch (0.049 in.) from said first end portion thereof, and having an outer diameter of from about three hundred thirty-three thousandths of an inch (0.333 in.) to about three hundred forty-eight thousandths of an inch (0.348 in.);

a second intermediate portion extending from about twenty-one thousandths of an inch (0.021 in.) to about forty-nine thousandths of an inch (0.049 in.) from said first intermediate portion thereof, and having an outer wall which increases in diameter from about a diameter of from about three hundred thirty-three thousandths of an inch (0.333 in.) to about three hundred forty-eight thousandths of an inch (0.348 in.) to about a diameter of from about three hundred ninety-two thousandths of an inch (0.392 in.) to about three hundred ninety-five thousandths of an inch (0.395 in.) at a substantially constant rate of increase of from about thirty degrees (30°) to forty degrees (40°) from the centerline of said casing; and, a second and opposite end portion extending for the remaining length of said casing, and having an outer wall which uniformly decreases in diameter from a diameter of from about three hundred ninety-two thousandths of an inch (0.392 in.) to about three hundred ninety-five thousandths of an inch (0.395 in.) to a diameter of from about three hundred seventy-two thousandths of an inch (0.372 in.) to about three hundred eighty thousandths of an inch (0.380 in.);

and as its interior dimensions:

a first interior portion extending from about one hundred fifteen thousandths of an inch (0.115 in.) to about one hundred twenty-one thousandths of an inch (0.121 in.) from the first end thereof, and having an inner diameter of from about one thousand seven hundred thirty-two ten-thousandths of an inch (0.1732 in.) to about one thousand seven hundred forty-four ten-thousandths of an inch (0.1744 in.);

a second interior portion extending for a minimum of at least about forty thousandths of an inch (0.040 in.), and having an inner diameter of about from seventy-nine thousandths of an inch (0.079 in.) to about eighty-three thousandths of an inch (0.083 in.);

a third interior portion extending to about from about five hundred seventy thousandths of an inch (0.570 in.) to about five hundred ninety thousandths of an inch (0.590 in.) from said first end of the casing, and having an inner diameter which increases to from about three hundred fifty-two thousandths of an inch (0.352 in.) to about three hundred fifty-six thousandths of an inch (0.356 in.); and, a fourth interior portion extending from said third interior portion to the second and opposite end of said casing, and having a constant inner diameter of from about three hundred fifty-two thousandths of an inch (0.352 in.) to about three hundred fifty-six thousandths of an inch (0.356 in.).

* * * * *